United States Patent [19]

Matsumoto et al.

[11] 4,388,092

[45] Jun. 14, 1983

[54] METHOD FOR PROCESSING LNG FOR RANKINE CYCLE

[75] Inventors: Osamu Matsumoto, Inagi; Ichizo Aoki, Yokohama, both of Japan

[73] Assignee: Chiyoda Chemical Engineering & Construction, Kanagawa, Japan

[21] Appl. No.: 228,920

[22] Filed: Jan. 27, 1981

[51] Int. Cl.[3] ..... F25J 3/00

[52] U.S. Cl. ..... 62/24; 62/28; 62/40

[58] Field of Search ..... 62/24, 28, 40

[56] References Cited

U.S. PATENT DOCUMENTS

| | | | |
|---|---|---|---|
| 3,218,816 | 11/1965 | Grenier | 62/28 |
| 3,479,832 | 11/1969 | Sarsten et al. . | |
| 3,846,993 | 11/1974 | Bates | 62/23 |
| 4,251,249 | 2/1981 | Gulsby | 62/28 |

*Primary Examiner*—Norman Yudkoff

*Attorney, Agent, or Firm*—Lowe, King, Price & Becker

[57] ABSTRACT

A method is disclosed for processing LNG using a mixed heat medium for performing a Rankine cycle to gasify the LNG. The medium is prepared by batch distillation using only LNG. The method comprises the steps of condensing an upflow vapor in a single distillation column employing part of the LNG in an LNG batch distillation cycle, venting one fraction having low boiling point components mainly containing methane, and accumulating the other fractions containing ethane and components heavier than ethane. The supply of LNG to be distilled in the column is halted. A total condensing operation is performed in which the other fractions are sequentially condensed by part of the LNG at the condenser to sequentially recover and mix each component with the other fractions. LNG is added as the methane component to the recovered mixture of components to prepare a mixed heat medium consisting of components selected from hydrocarbons having 1–6 carbon atoms, or hydrocarbons having 1–6 carbon atoms and nitrogen. The mixed heat medium is stored. A mixed heat medium vapor generated by heat input to the stored mixed heat medium is condensed by LNG and returned to the mixed heat medium; collection and complete gasification of the low boiling point components mainly containing methane and the LNG is gasified by condensation to provide an LNG vapor gas. LNG is gasified by performing the Rankine cycle with the mixed heat medium.

3 Claims, 1 Drawing Figure

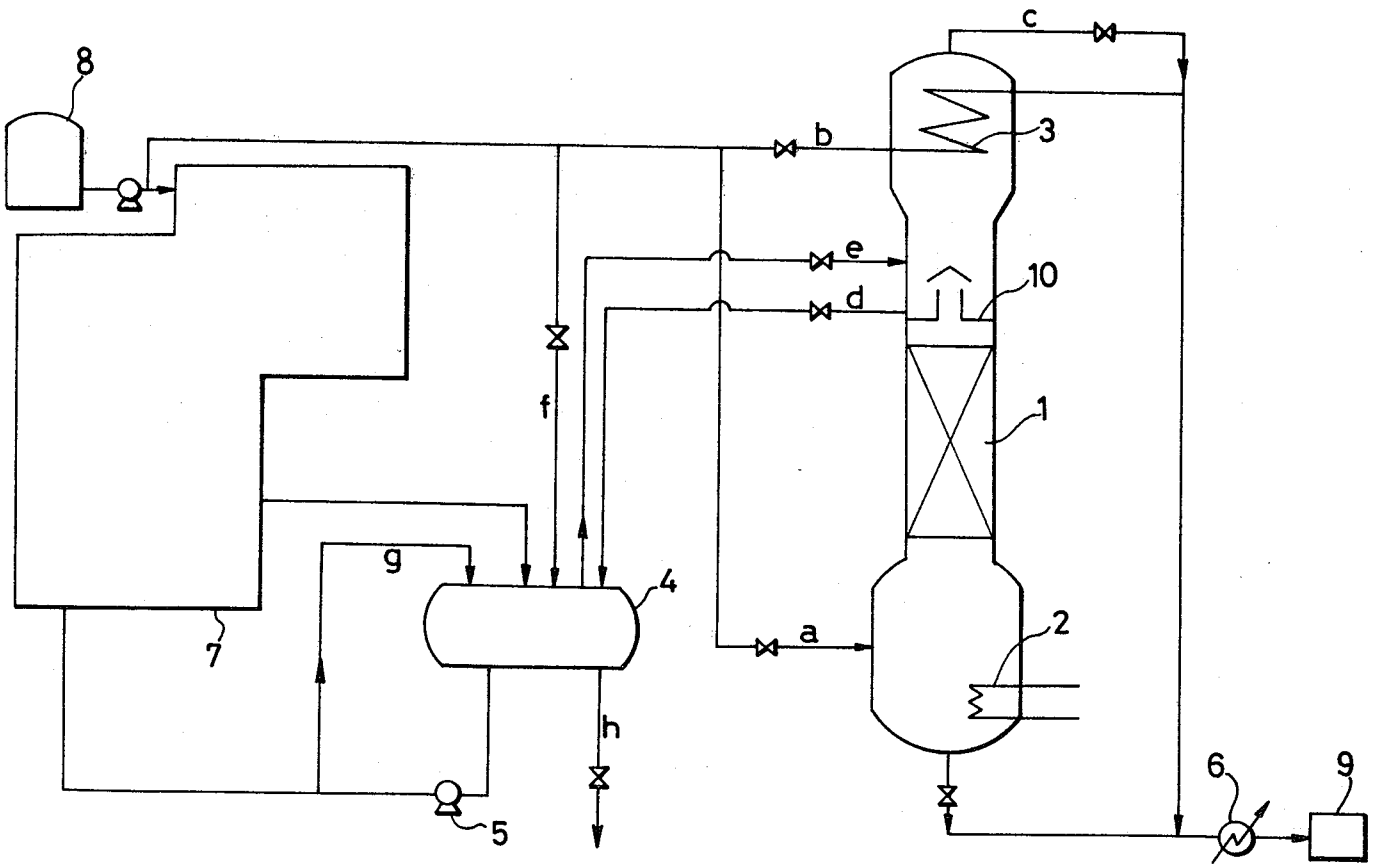
9
6
c
3
10
1
2
b
e
d
a
4
h
f
5
g
7
8

METHOD FOR PROCESSING LNG FOR RANKINE CYCLE

SUMMARY OF THE INVENTION

The present invention relates to a method for processing LNG.

In a method for gasifying LNG using the Rankine cycle of a mixed heat medium, the present applicant proposed a method for efficiently utilizing the cold potential of LNG as a power source in Japanese Laid-Open Patent Application No. 17401/74. The mixed heat medium mainly consists of hydrocarbons of 1-6 carbon atoms. The composition of the mixed heat medium is determined to maximize the power recovery efficiency depending on the composition of the LNG, the supply pressure of the re-gasified natural gas, the temperature conditions of the high temperature source fluid, and the like. In order to operate the above-mentioned Rankine cycle, a mixed heat medium of a predetermined composition and amount must be prepared.

A known method for preparing mixed heat medium from LNG, which is regarded as the object of gasification, is to dispose a plurality of fractionation towers such as a demethanizer, deethanizer and depropanizer to rectify the respective components of LNG, and to mix them to prepare the medium. This method is known for preparing a mixed refrigerant in the liquefying process of a natural gas. However, since it requires a plurality of fractionation towers and equipment for storing the respective components, construction cost increases, rendering this method economically disadvantageous.

The primary object of the present invention is to eliminate the above-mentioned problem by providing a method for processing LNG by separating and recovering each component of LNG as needed to prepare the components of the mixed heat medium with a single distillation process at a lower cost, when components making up the mixed heat medium are included in the LNG components to be gasified and are not obtained as simple substances in a great amount and low cost.

Another object of the present invention is to provide a method for processing LNG wherein a single distillation process, that is, which a single distillation tower properly controls a heating temperature or the like, utilize part of the LNG as the condensation fluid without requiring other special condensation fluid when each component of LNG is separated and recovered to obtain a mixed heat medium and LNG vapor gas. Thus, in comparison with conventional methods, the method of the present invention requires less costly equipment. Further, another advantage is that a mixed heat medium composition is arbitrarily adjusted as needed when it is necessary to change it due to a change in LNG composition to be gasified or the like. Further, in comparison with the known method of separately preparing each component of the mixed heat medium as simple substances, each component is prepared in a large amount and at low cost in the present method for processing LNG.

A further object of the present invention is to provide a method for processing LNG comprising the steps of controlling components of a reflux liquid by properly selecting the distillation conditions such as the heating temperature or the like in the distillation; drawing the reflux liquid under the specified conditions and storing it for preparing a mixed heat medium; repeating the sequence of above operations according to the composition of the required mixed heat medium; supplying methane to the stored reflux liquids as needed by supplying LNG without using other material and obtaining the mixed heat medium; performing a Rankine cycle using the obtained mixed heat medium to gasify the LNG and to recover energy from cold potential wherein components of the mixed heat medium are selected from the hydrocarbons of 1-6 carbon atoms or hydrocarbons having 1-6 carbon atoms and nitrogen; condensing the mixed heat medium vapor generated by the heat input to the mixed heat medium storage at a condenser in which the other part of LNG is used as refrigerant in the distillation tower; and liquefying the vapor to return to the mixed heat medium. Thus, the material is not wasted and energy is efficiently saved.

BRIEF DESCRIPTION OF THE DRAWING

The drawing is a process flow line diagram of the embodiment of the method according to the present invention.

DETAILED DESCRIPTION OF THE INVENTION

The method of the present invention is described in detail by way of its embodiment. However, the present invention is not limited by this.

An example of compositions of LNG and a mixed heat medium is shown below:

| (a) LNG Composition | |
|---|---|
| $C_1$ | 89.85 mol % |
| $C_2$ | 5.89 mol % |
| $C_3$ | 2.92 mol % |
| i-$C_4$ | 0.56 mol % |
| n-$C_4$ | 0.74 mol % |
| i-$C_5$ | 0.04 mol % |
| | 100.00 mol % |
| **(b) Mixed Heat Medium Composition** | |
| $C_1$ | 25.35 mol % |
| $C_2$ | 53.16 mol % |
| $C_3$ | 15.10 mol % |
| n-$C_4$ | 6.39 mol % |
| | 100.00 mol % |

In the above-mentioned example, the LNG has methane as its main component, while the mixed heat medium has ethane as its main component.

The method for preparing the mixed heat medium from the above LNG will now be described with reference to the process flow chart in the drawing.

LNG supplied from an LNG tank 8 through a line (a) is introduced to the bottom of a distillation tower 1, while LNG as the refrigerant is also supplied to a condenser 3 inside the tower through a line (b). The bottom fluid in a reboiler 2 is heated at the bottom of the tower and thus the distillation operation is initiated. At the beginning, methane alone is distilled from the top of the tower through a line c by partial condensation. The LNG is continuously supplied through the line (a) while the fluid level of the tower bottom section is measured. With this operation, the composition in the tower becomes high in ethane and components heavier than ethane. Changes in composition are measured by the internal pressure of the tower and the temperature of the tower bottom.

When the ethane concentration becomes 50% at an internal tower pressure of 2.1 $Kg/cm^2G$ and at a temperature of $-110°$ C. (the methane concentration is about 15%), the supply of LNG is stopped and the so-called "stripping operation" for the residual methane is performed. When the methane is completely removed, the ethane begins flowing upwardly from the tower bottom to condenser 3 and to change to the total condensing operation at the condenser. Part of reflux fluid is drawn from a nozzle at a chimney tray 10 through a line (d) and stored in a mixed heat medium storage tank 4. Initially, the distillate composition includes methane in a concentration of about 5%. However, the concentration of the ethane fraction gradually increases to 95–100%. Thus, the fluid composition in the storage tank 4 becomes a composition containing ethane in a 98% concentration. In the step in which distillate is stored in storage tank 4, vapor generated by natural heat input to the storage tank 4 is returned to the vapor phase at the highest stage of the distillation tower through a gaseous phase connecting pipe (e) and is condensed again.

Immediately after the ethane fraction distillation is terminated in correspondence with measurements of the internal tower pressure and temperature, a propane fraction distillation is begun. The ratio of propane to ethane in the LNG is twice the ratio in the mixed heat medium so that the propane fraction is distilled in the required amount. Excessive propane is drawn as residual fluid from the bottom of the tower. Thus, the amount of propane to be added to the mixed heat medium can be reduced. As in the ethane distillation, propane and butane are continuously distilled and mixed in the storage tank 4.

The shortage of a methane fraction is compensated for by the LNG having methane as its main component into the storage tank 4 through the line (f).

With the above-mentioned operation, the resultant composition approaches the required composition of the mixed heat medium. The fluid inside the storage tank is mixed well by means of a medium fluid supply pump 5 through a line (g) in minimum flow operation. Sampling fluid is drawn through a line (h) and its composition is measured. If the methane fraction is still required, LNG is supplied through the line (f). If other components having a higher boiling point than ethane are still required, they are added by the above-mentioned fractional distillation cycle in order to obtain finally the required composition of the mixed heat medium.

In the above process, the vapor discharged from the top of the distillation tower, the evaporated vapor as refrigerant at the condenser, and the residual fluid from the bottom of the distillation tower are completely gasified by a drain gasifier 6. They are sent to and recovered by a vapor gas recovery system 9 of the LNG tank so that there is no loss.

Whether or not a mixed heat medium Rankine cycle 7 is in operation, the vapor generated by heat input at storage tank 4 is condensed by condenser 3 of distillation tower 1. Therefore, the mixed heat medium can be prevented from being lost whether or not the cycle 7 is in operation.

In the batch distillation cycle of ethane or the like, the component at the top of the distillation tower has a higher boiling point than the LNG, so that adequate condensation is accomplished by the difference between the condensation temperature of the components at the top of the distillation tower and the vaporizing temperature of the LNG as the refrigerant.

On the other hand, if supply of mixed heat medium or a specified component is required when the mixed heat medium Rankine cycle 7 is in operation, the valve of the line (e) is closed to separate the distillation tower 1 from the medium storage tank, and the above-mentioned fractional batch cycle is performed. After unnecessary components are thus discharged from the top of the distillation tower, the valve of the line e is opened. Thus, the necessary fractions can be supplied in the medium storage tank 4.

It is difficult to obtain pure ethane at a low cost on an industrial scale. Since the LNG usually contains the ethane component, the present invention can be applied to separate the ethane component from the LNG at a low cost.

What is claimed is:

1. In an LNG gasification process in which a cold potential of LNG is converted into power with a Rankine cycle using a mixture of hydrocarbons $C_1$ to $C_6$ as a medium, a method for producing the medium to be used in said Rankine cycle using a single distillation tower and part of the LNG to be gasified as a raw material, comprising the steps of:

(a) continuously feeding part of an LNG supply to a bottom section of said distillation tower and another part of an LNG supply to a condenser as a refrigerant, stripping a $C_1$ component to accumulate $C_2$ and heavier components at a predetermined concentration inside said tower by heating LNG within a reboiler and partially condensing at said condenser, and recovering an overhead vapor mainly containing the stripped $C_1$ component and vaporized refrigerant at said condenser;

(b) terminating supply of LNG to said tower after the $C_2$ and heavier components inside said tower reach said predetermined concentration, completely stripping the $C_1$ component in said tower, and performing total condensation of a residual liquid comprising $C_2$ and heavier components using LNG as a refrigerant at said condenser, thereby sequentially extracting $C_2$ to $C_4$ components respectively from a top tray of said tower and recovering and storing the $C_2$ to $C_4$ components according to a required composition of the medium while recovering LNG used at said condenser in the form of a gas;

(c) draining and recovering residual heavier fractions from said tower after carrying out step (b);

(d) repeating a batch distillation operation comprising steps (a) to (c) to produce and store the required quantity of $C_2$ to $C_4$ components necessary for the medium; and (e) adding a predetermined amount of LNG to the $C_2$ to $C_4$ components stored in step (d) to provide a composition and quantity of the medium for the Rankine cycle.

2. The method of claim 1 wherein medium is introduced into the Rankine cycle of the process to convert LNG cold potential into power.

3. The method of claim 1 wherein batch distillation is simultaneously performed during the process for converting LNG cold potential into power so as to supplement part or all of the components of the medium.

* * * * *